US006273146B1

(12) United States Patent
Herring

(10) Patent No.: US 6,273,146 B1
(45) Date of Patent: Aug. 14, 2001

(54) PAPERMAKING FABRIC SEAM WITH ADDITIONAL THREADS IN THE SEAM AREA

(75) Inventor: Samuel H. Herring, Simpsonville, SC (US)

(73) Assignee: AstenJohnson, Inc., Charleston, SC (US)

( * ) Notice: Subject to any disclaimer, the term of this patent is extended or adjusted under 35 U.S.C. 154(b) by 0 days.

(21) Appl. No.: 09/384,355

(22) Filed: Aug. 27, 1999

Related U.S. Application Data

(60) Provisional application No. 60/098,547, filed on Aug. 31, 1998, provisional application No. 60/097,831, filed on Aug. 31, 1998, provisional application No. 60/098,566, filed on Aug. 31, 1998, provisional application No. 60/098,567, filed on Aug. 31, 1998, and provisional application No. 60/098,573, filed on Aug. 31, 1998.

(51) Int. Cl.[7] ..... D03D 13/00; D21F 1/00; D21F 7/10

(52) U.S. Cl. ..... 139/383 AA; 442/270; 428/58; 428/193; 162/904

(58) Field of Search ..... 139/383 AA; 162/904; 428/58, 193; 442/270

(56) References Cited

U.S. PATENT DOCUMENTS

| | | | |
|---|---|---|---|
| 3,316,599 | 5/1967 | Wagner . | |
| 4,186,780 | 2/1980 | Josef et al. . | |
| 4,438,789 | 3/1984 | MacBean | 139/383 A |
| 4,601,785 | 7/1986 | Lilja et al. . | |
| 4,842,925 | 6/1989 | Dufour et al. . | |
| 4,979,543 | 12/1990 | Moriarty et al. . | |
| 5,188,884 | 2/1993 | Smith . | |
| 5,458,161 | 10/1995 | Scarfe . | |
| 5,476,123 | 12/1995 | Rydin . | |
| 5,531,251 | 7/1996 | Rydin . | |
| 5,799,709 | 9/1998 | Shipley . | |
| 5,913,339 | 6/1999 | Lee . | |

*Primary Examiner*—Andy Falik
(74) *Attorney, Agent, or Firm*—Volpe & Koenig, PC

(57) ABSTRACT

An open ended papermaker's fabric of the type woven from longitudinal and transverse thread systems including a plurality of seam loops at each end of the fabric. A seam zone exists at each end of the fabric between the respective seam loops and the last thread of the transverse thread system. At least one additional transverse thread is interwoven in at least one seam zone in a repeat pattern having a ratio of interlacings with longitudinal machine side threads to paper side longitudinal threads greater than zero and less than or equal to 1 in 6.

12 Claims, 14 Drawing Sheets

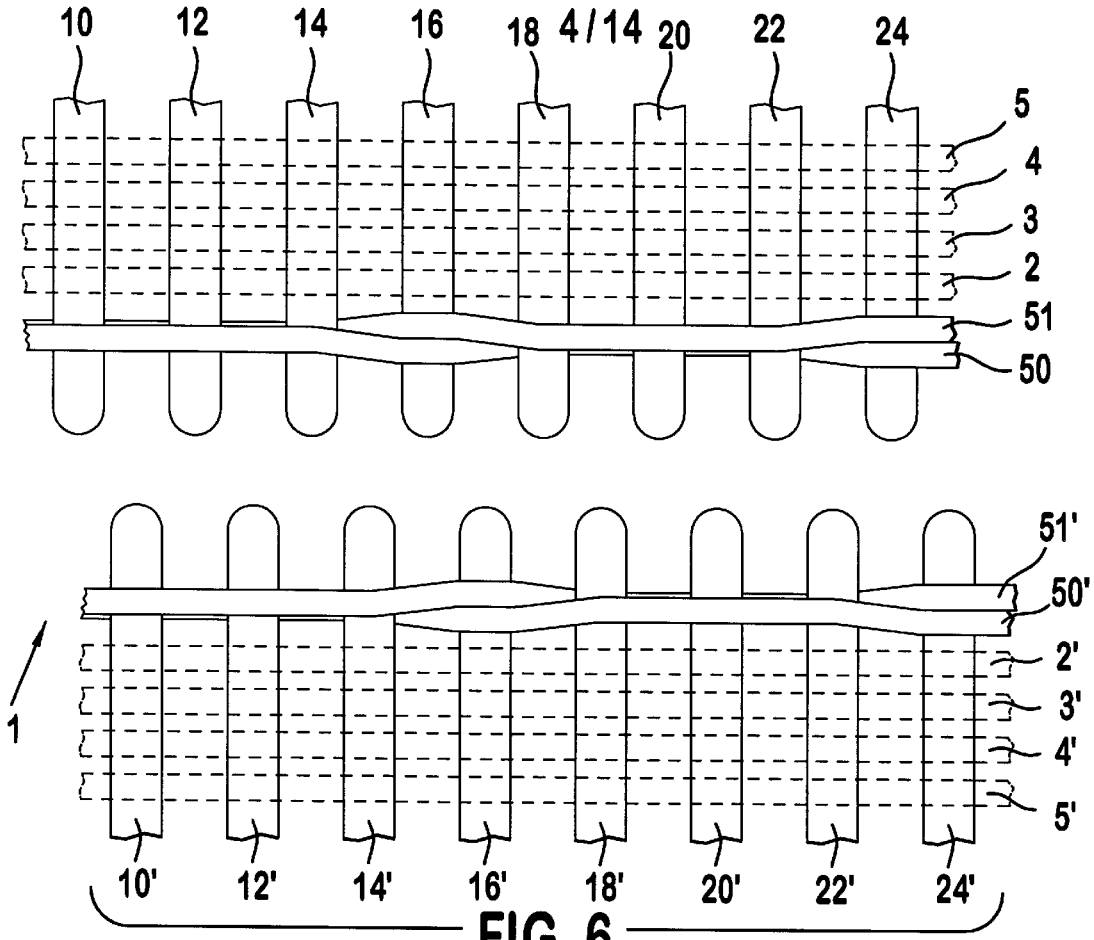
FIG. 6
FIG. 7
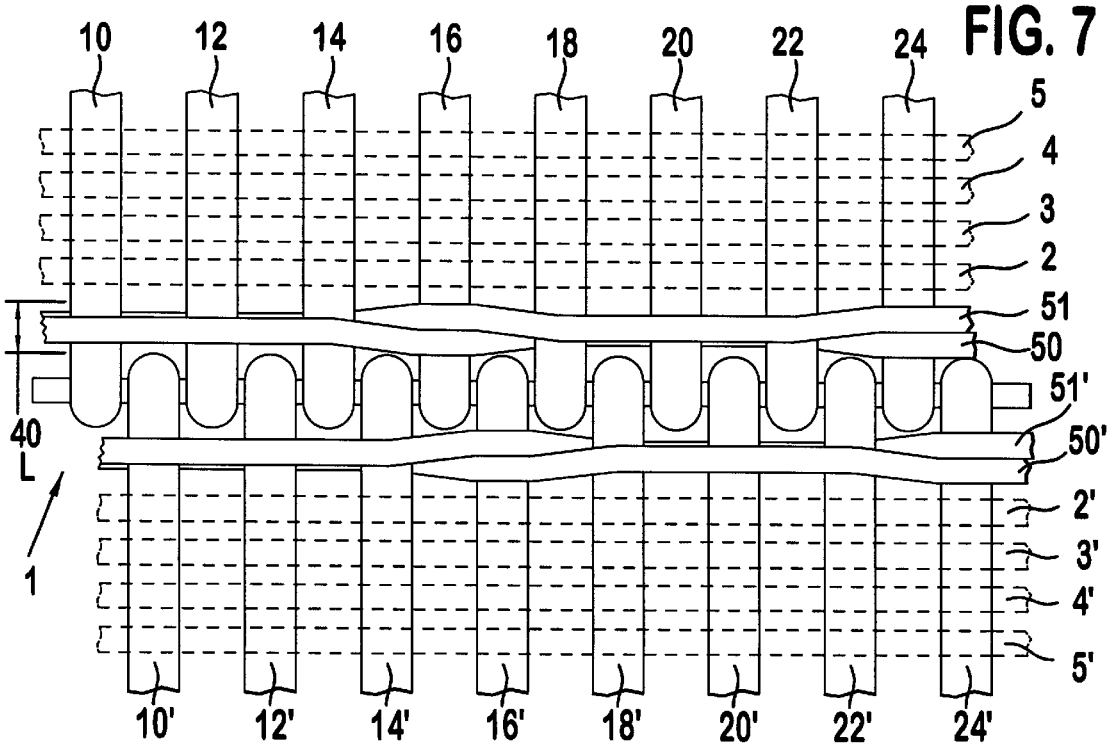

PAPERMAKING FABRIC SEAM WITH ADDITIONAL THREADS IN THE SEAM AREA

This application claims the benefit of: U.S. Provisional Application Serial No. 60/098,547, filed Aug. 31, 1998; U.S. Provisional Application Serial No. 60/097,831, filed Aug. 31, 1998; U.S. Provisional Application Serial No.60/098,566, filed Aug. 31, 1998; U.S. Provisional Application Serial No.60/098,567, filed Aug. 31, 1998; and U.S. Provisional Application Serial No. 60/098,573, filed Aug. 31, 1998.

BACKGROUND

The present invention generally relates to an open ended, woven fabric which is designed for use in a papermaking, cellulose or board manufacturing machine. The fabric has a plurality of loops at each end to form a seam for rendering the fabric endless.

As will be known to those skilled in the art, papermaking machines generally include three sections commonly referred to as the forming, press and dryer sections. The present invention finds particular application in the press section of a papermaking machine.

Typically, press felts include a supporting base, such as a woven fabric, and a paper carrying or supporting layer. Frequently, the paper support layer is a homogeneous, non-woven batt that has been affixed to the base. Base fabrics are typically woven fabrics which are used as an endless loop. Such an endless loop fabric may be woven endless with no seam or the fabric may be woven with two ends which are joined by a seam. Typical seams include pin type seams which utilize a pintle inserted through intermeshed seam loops to close the fabric.

Some prior art seams have employed threads in the seam area to increase batt adhesion in this area. However, these efforts have not always produced the desired sheet contact or loop length in the seam area. Additionally, some of the prior art seams do not provide the desired interconnection between paper and machine side machine direction threads. See U.S. Pat. Nos. 5,476,123 and 5,531,251. FIG. 1 shows a prior art seam area with a pair of additional threads A and B in complementary plain weave patterns interwoven in the fabric seam zone 40. Thread A weaves over and under paired MD threads and thread B weaves oppositely with the same pairs. In addition to not always providing the desired contact area, this seam has a loop length L which is larger than desired.

There exists a need to provide increased sheet contact in the seam zone through better batt anchorage, and a shortened loop length which is balanced between the paper and machine sides.

SUMMARY

The present invention relates to an open ended papermaker's fabric of a type woven from a longitudinal thread system and a transverse thread system. A plurality of seam loops are formed at each end of the fabric by the threads of the longitudinal thread system. A seam zone exists at each end of the fabric between the respective seam loops and the last thread of the transverse thread system. At least one additional transverse thread is interwoven in at least one seam zone with the longitudinal thread system in a repeat pattern having a ratio of interlacings with longitudinal machine side threads to paper side longitudinal threads greater than zero and less than or equal to 1 in 6.

BRIEF DESCRIPTION OF THE DRAWINGS

FIG. 6 is a top plan view of the two ends of the fabric of FIG. 2 prior to joining together thereof.

FIG. 7 is a top plan view of the two ends of the fabric of FIG. 2 joined together.

DESCRIPTION OF THE PREFERRED EMBODIMENTS

Figure 1:
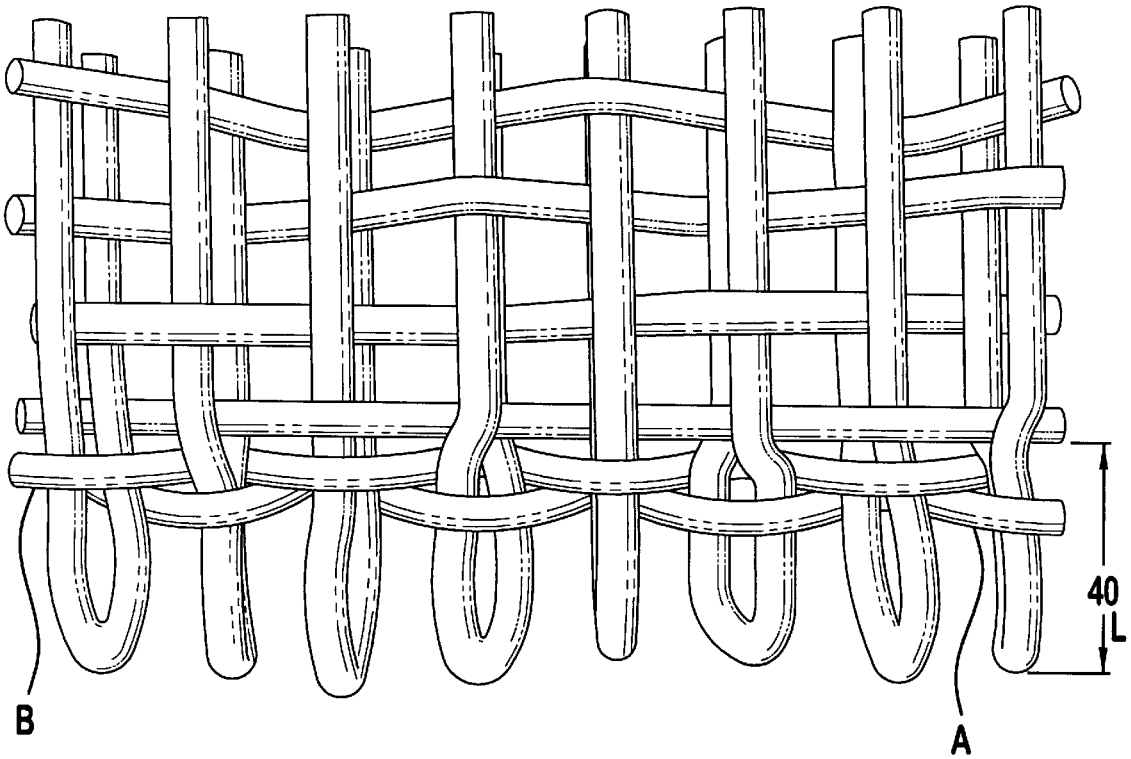
FIG. 1 PRIOR ART
FIG. 1 is a top plan view of a prior art fabric seam.

The preferred embodiments will be described with reference to the drawing figures where like numerals represent like elements throughout.

Figure 2:
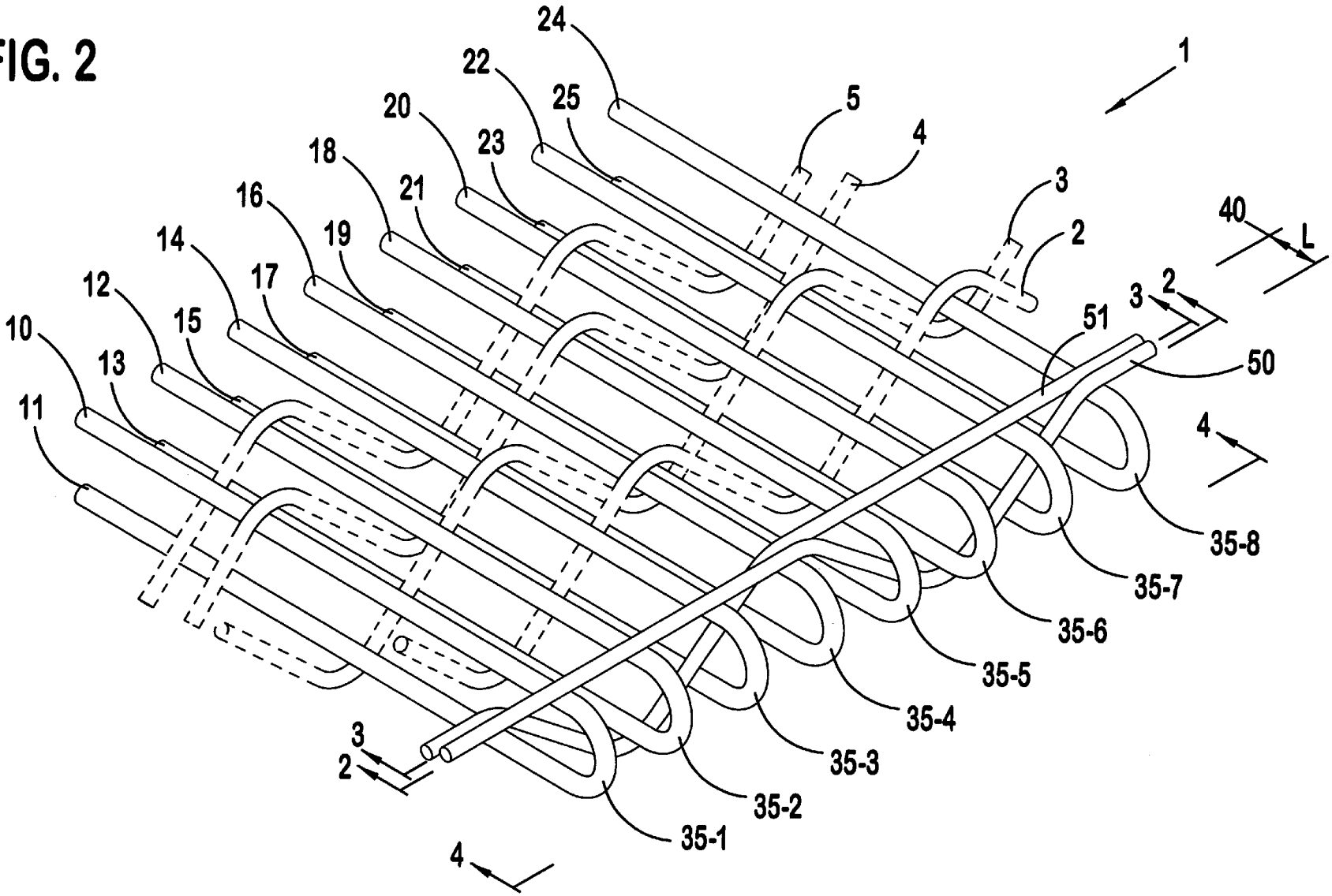
FIG. 2 is a schematic perspective view of a portion of one end of the base fabric of a first embodiment of the present invention.

Referring to FIG. 2, it shows a portion of one end of the base fabric seam loops with additional threads woven in accordance with a first embodiment of the present invention. The base fabric 1 comprises a top layer of MD threads, 10, 12, 14, 16, 18, 20, 22, and 24, and a bottom layer of MD threads, 11, 13, 15, 17, 19, 21, 23 and 25. It will be understood that the top and bottom layers are essentially continuous threads which form the seam loops 35-1 to 35-8 between the top and bottom layers.

Typically, the body CMD threads 2–5, shown in phantom, are interwoven with the top and bottom MD thread layers in a given repeat pattern to form the body of the fabric. A seam zone 40 exists between the end CMD thread 2 and the seam loops 35-1 to 35-8. The weave pattern of the body CMD threads 2–5 can be varied to provide the desired characteristics of the fabric 1.

Figure 3:
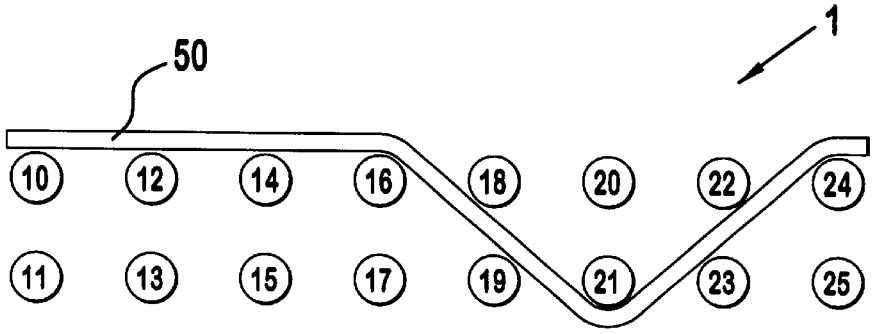
FIG. 3 illustrates one weave repeat pattern for one of the additional threads of the fabric of FIG. 2.
Figure 4:
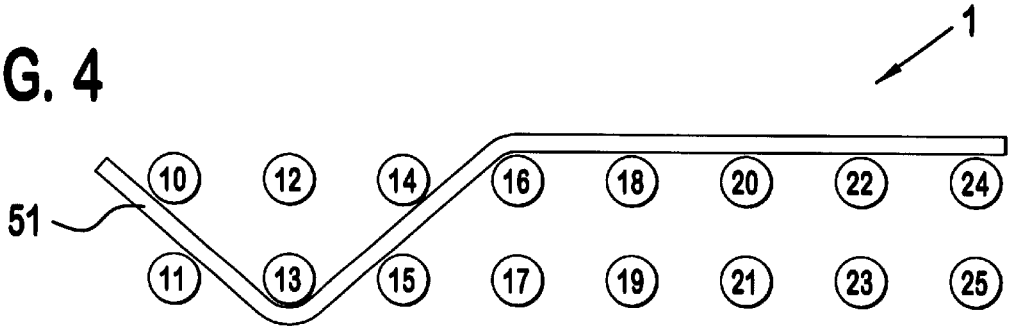
FIG. 4 illustrates one weave repeat pattern for a second a second additional thread of FIG. 2.
Figure 5:
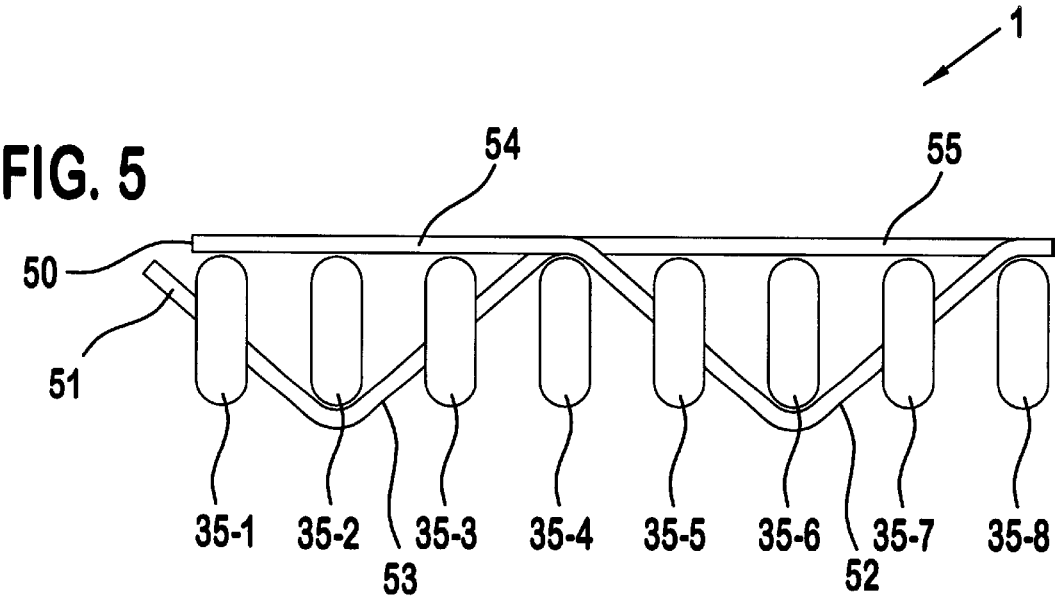
FIG. 5 is an elevation view of the fabric taken along line 5—5 in FIG. 2.

Reference is now made to FIGS. 3–5. Although some benefits will be obtained with a single thread, in the preferred embodiments, two additional threads are preferred for increased uniformity in the paper side surface. Although, the fabric will be described with the preferred two additional threads in each end of the fabric, the additional threads may be provided along only one end of the fabric.

The two additional CMD threads 50 and 51 are interwoven in the seam zone 40 with both layers of MD threads 10 through 25. As shown in FIG. 3, additional CMD thread 50 weaves in a repeat that passes over MD threads 10–17, between threads 18–19, under threads 20–21, between threads 22–23 and over threads 24–25. With reference to FIG. 4, the second additional thread 51 is woven in a repeat pattern which is shifted four MD thread pairs compared to that of thread 50. Thus, CMD thread 51 weaves in a repeat that passes between the paired threads 10–11, beneath the paired threads 12–13, between the paired threads 14–15, and over threads 16–25.

As can be seen from FIG. 5, two threads 50, 51 woven in accordance with FIGS. 3 and 4 produce a weave repeat structure wherein each machine side interlacing 52 and 53, respectively, is aligned with the paper side float 54 and 55 of the other additional thread 50, 51 respectively. The repeat pattern extends over eight pairs of MD threads with minimal interlacing in the machine side MD layer. As a result of the long floats 54,55 and the single machine side interlacings, the threads 50 and 51 migrate relative to each other and the seam zone 40 has effectively one long float across the width of the fabric. This result is illustrated in FIGS. 6 and 7. This effect may be further enhanced by selecting the additional threads 50, 51 from materials with no or low twist which allow them to flatten and cover more of the seam zone 40.

Figure 8:
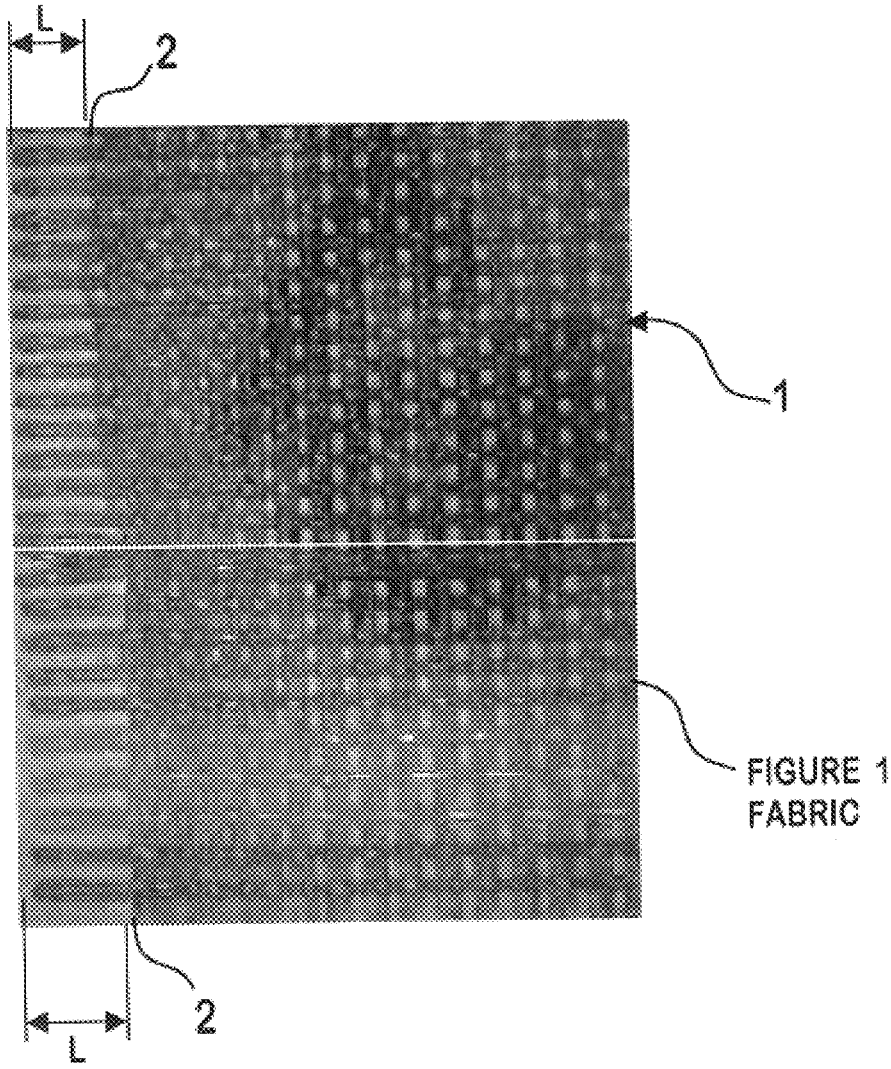
FIG. 8 is a photomicrograph top plan view of the fabric of the first embodiment adjacent to the fabric of FIG. 1, both fabrics with their additional threads removed.

The invention results in a loop length L, the distance between the end CMD thread 2 and the end of the seam loops, which is shortened over the prior art. Referring to FIG. 8, a photomicrograph of the seam area of the fabric of the present embodiment between each of the pairs of paper side and machine side longitudinal thread 1 is shown adjacent to the seam area of the fabric woven in accordance with FIG. 1. The additional threads have been removed from each fabric. As shown in the photographs, the loop length L of the present embodiment 1 is shorter than the loop length L of the prior art fabric.

Table 1 below provides a comparison of the loop lengths at each end of the fabrics between the prior art fabric of FIG. 1 and embodiments of the present invention. The comparisons are based on identical body fabric weaves and thread material and sizes. The fabrics are identical except for the weave patterns of the additional threads. The loop lengths are measured in pixels with a Photovolt, Microwatcher, microscope, Model VS-35H, at a magnification of 50X wherein 458 pixels are equal to 0.100".

TABLE 1

Figure 9:
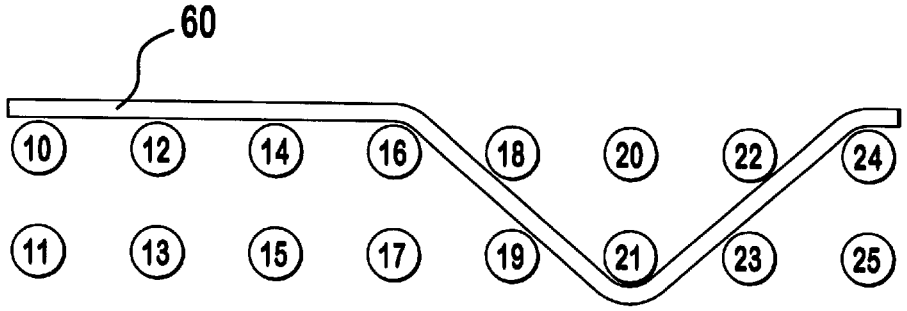
FIG. 9 illustrates the weave repeat for one additional thread in accordance with a second embodiment.
Figure 10:
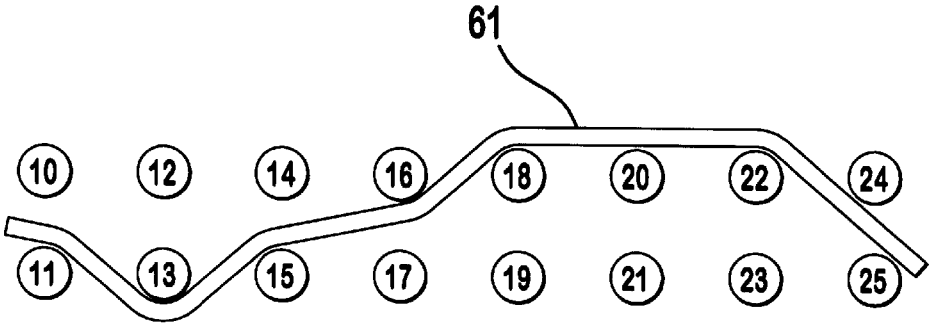
FIG. 10 illustrates the weave repeat for a second additional thread in accordance with the second embodiment.
Figure 15:
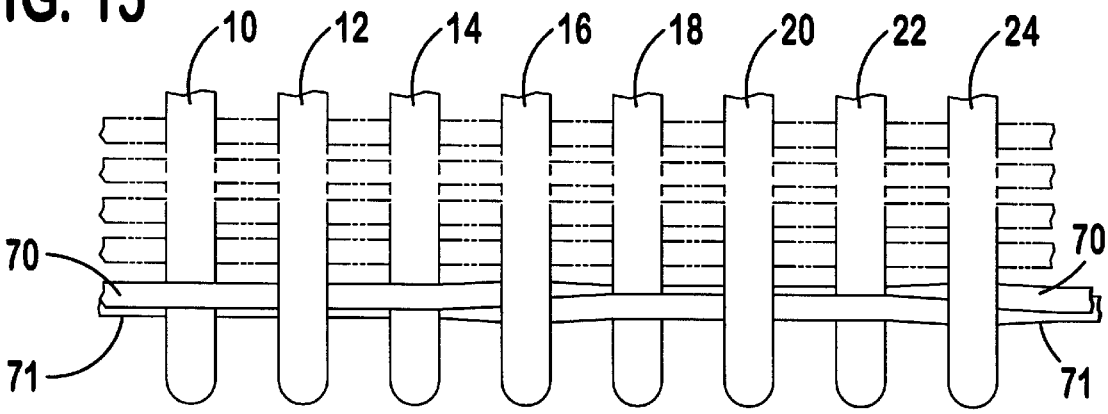
FIG. 15 is a top plan view of the combined weave patterns as illustrated in FIGS. 12–14.
Figure 16:
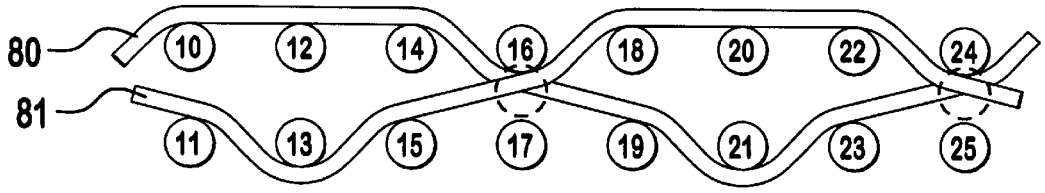
FIG. 16 illustrates the weave repeat for the additional threads in accordance with a fourth embodiment.

| FABRIC | LOOP LENGTH AT FIRST END | % REDUCTION OVER PRIOR ART | LOOP LENGTH AT SECOND END | % REDUCTION OVER PRIOR ART |
|---|---|---|---|---|
| FIG. 1 - PRIOR ART | 478 | — | 470 | — |
| FIGS 2–7 | 412 | 13.8 | 389 | 17.2 |
| FIGS 8–10 | 412 | 13.8 | 389 | 17.2 |
| FIGS 11–14 | 385 | 19.5 | 364 | 22.6 |
| FIGS 15–16 | 415 | 13.2 | 405 | 13.8 |

As shown in Table 1, the loop lengths L of the present embodiment, FIGS. 2–7, are reduced by between 13.8 and 17.2%

It may also be desirable, although not necessary, to weave the additional threads in what will be opposed seaming ends of the fabric in reverse positioning with respect to each other. As illustrated in FIG. 7, the additional thread 51 is adjacent the last CMD thread 2 in one end of the fabric 1, and additional thread 50' is adjacent to the last CMD thread 2 in the opposed end. This allows the two ends of the fabric 1 to complement each other when the fabric 1 is joined.

Figure 11:
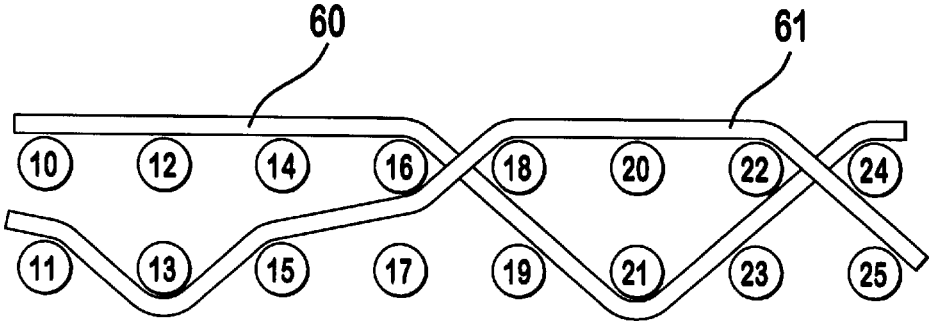
FIG. 11 shows the weave repeats of FIGS. 9 and 10 in combination.
Figure 12:
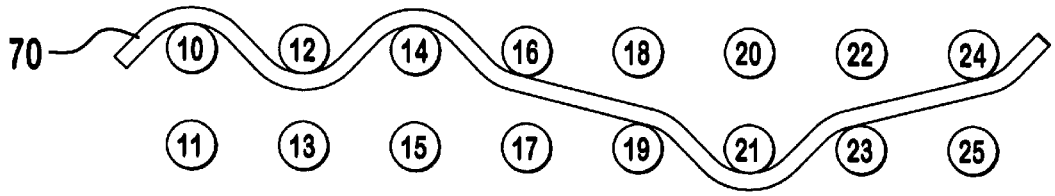
FIG. 12 illustrates the weave repeat for one additional thread in accordance with a third embodiment.

A second embodiment is disclosed with respect to FIGS. 9–11. Additional thread 60 is woven in the same manner as in FIG. 3 with respect to the first embodiment. The weave of additional CMD thread 61 is modified as depicted in FIG. 10. Thread 61 weaves between paired MD threads 10, 11, under MD threads 12 and 13, between paired MD threads 14,15 and 16,17, over MD threads 18–23 and between paired MD threads 24, 25. As seen in FIG. 11, the effective long float across the width of the fabric is maintained with this pattern. As shown in Table 1, threads 60, 61 tend to migrate towards the loops 35-1 to 35-8 and shorten the loop lengths L by between 13.8 and 17.2%.

Referring to FIGS. 12–15, a third embodiment of the present invention is shown. Each additional CMD thread 70 and 71 is interwoven in the seam zone 40 with both layers of MD threads 10 through 25. Additional CMD thread 70 preferably weaves in a repeat that passes over MD threads 10–11, between threads 12–13, over threads 14–15, between the thread pairs 16,17 and 18,19, under threads 20–21 and between the paired threads 22,23 and 24,25.

Figure 13:
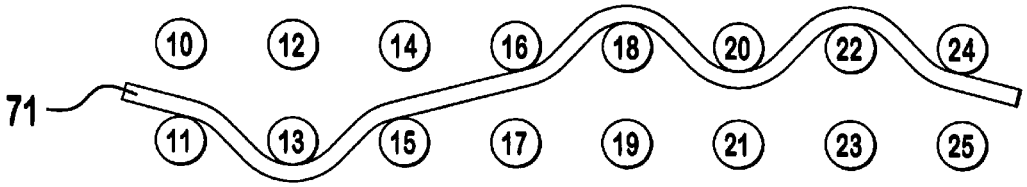
FIG. 13 illustrates the weave repeat for a second additional thread in accordance with the third embodiment.
Figure 14:
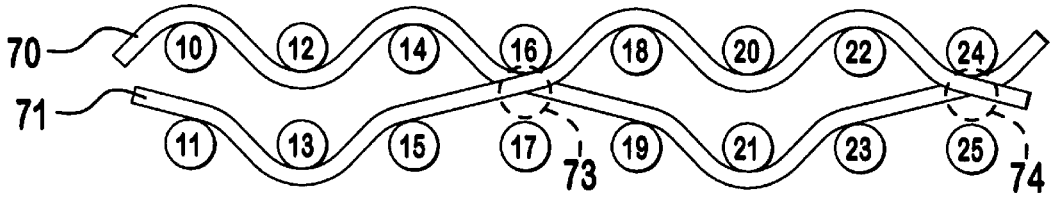
FIG. 14 shows the weave repeats of FIGS. 12 and 13 in combination.

With reference to FIG. 13, the second thread 71 is woven in a mirror image to the thread 70. Thus, CMD thread 71 weaves in a repeat that passes between the paired threads 10–11, beneath the threads 12–13, between the paired threads 14,15 and 16,17, over the threads 18–19, between paired threads 20–21, over paired threads 22–23, and between threads 24–25. As can be seen from FIG. 14, threads woven in accordance with FIGS. 12 and 13 produce a weave repeat structure having crossover points 73 and 74 which are spaced apart by at least three MD threads. It will also be noted that MD thread 16 passes over both additional threads 70 and 71. Since the repeat pattern extends over eight pairs of MD threads with only a single interlacing with the machine side MD layer, providing a ratio of interlacings with longitudianl machine side threads to paper side longitudinal threads of 1 in 8, the threads can shift beneath thread 16 and threads 70 and 71 tend to act as one. As a result of the long transition and the single interlacing with the machine side MD layer, the threads 70 and 71 can migrate relative to each other so that the resulting sheet side MD and CMD weave repeat appears to be a plain weave, as shown in FIG. 15. With this embodiment, the loop lengths L are shortened by approximately 19.5 to 22.6%.

Figure 17:
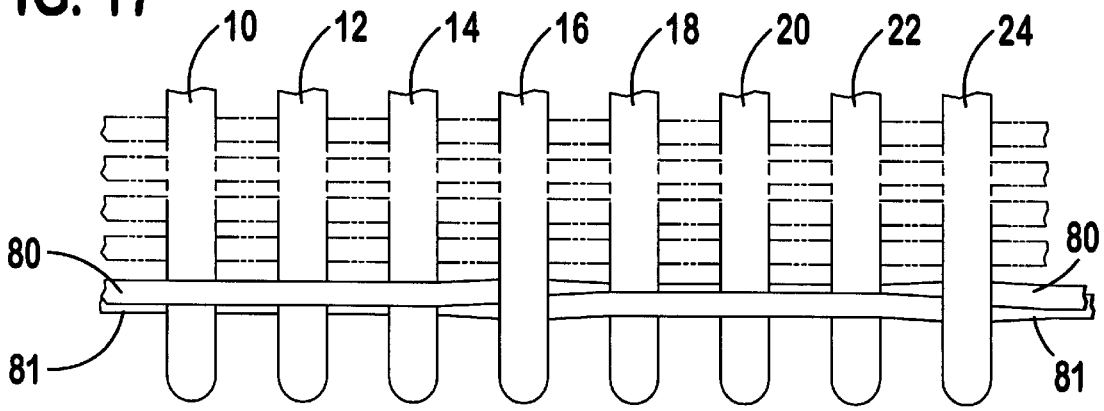
FIG. 17 is a top plan view of the combined weave patterns as illustrated in FIG. 16.

With reference to FIGS. 16 and 17, there is shown a fourth embodiment 150. In this fourth embodiment, weave repeats of the CMD threads 80 and 81 result in floats over three MD threads 10, 12 and 14 and over three MD threads 18, 20, and 22. The long transition between pairs of machine direction threads and the interlacing with a single machine side MD thread per repeat is as previously described. Thus, the threads 80 and 81 will migrate relative to each other and produce relatively large, in-line sheet side floats and shortened loop lengths L.

Although the remaining embodiments have not been tested to confirm such, it is believed that the fabrics will also experience shortened loops lengths do to their long transitions and minimal interlacings with the machine side MD threads. This is particularly true for the embodiments shown in FIGS. 18–29 which repeat on twelve MD pairs while interlacing with only a single machine side MD thread.

Figure 18:
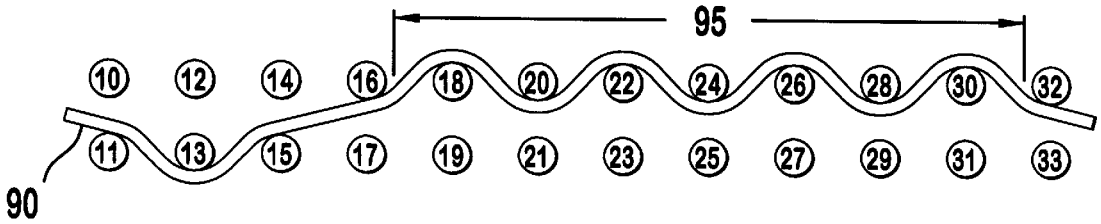
FIG. 18 illustrates the weave repeat for one additional thread in accordance with a fifth embodiment.
Figure 19:
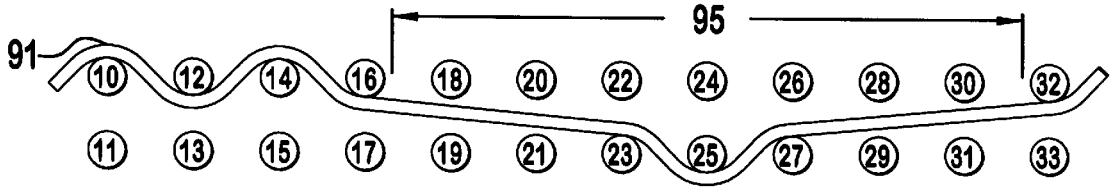
FIG. 19 illustrates the weave repeat for a second additional thread in accordance with the fifth embodiment.
Figure 20:
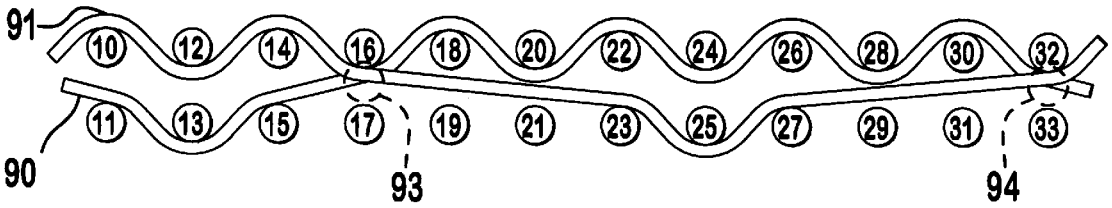
FIG. 20 shows the weave repeats of FIGS. 18 and 19 in combination.
Figure 21:
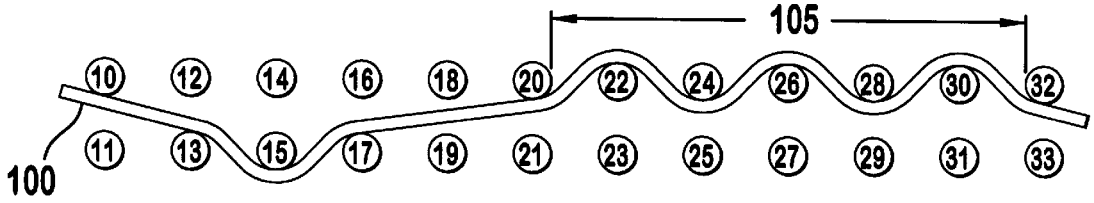
FIG. 21 illustrates the weave repeat for one additional thread in accordance with a sixth embodiment.
Figure 22:
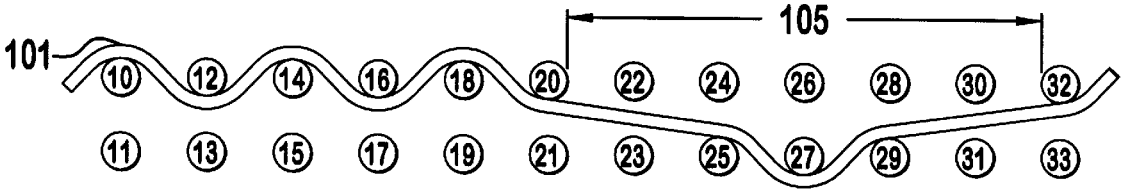
FIG. 22 illustrates the weave repeat for a second additional thread in accordance with the sixth embodiment.

A fifth embodiment of the present invention is shown in FIGS. 18–20. The fabric of this embodiment repeats on twenty four MD threads 10–33. The two additional threads 90 and 91 are interwoven in the seam zone 40 with both layers of longitudinal threads 10 through 33. Additional CMD thread 90 weaves in a repeat pattern that passes between MD threads 10–11, under MD threads 12–13, between MD thread pairs 14,15 and 16,17, and then weaves a continuous portion of plain weave with top layer MD threads 18, 20, 22, 24, 26, 28,30 before transitioning down between MD threads 32–33. With reference to FIG. 19, the second additional thread 91 is woven in a complementary pattern to that of thread 90. Additional thread 91 weaves a plain weave construction with top layer threads 10, 12, 14 before transitioning into a mid-plane float between MD thread pairs 16–17, 18–19, 20–21, 22–23, weaving under MD threads 24–25 and transitioning back to a mid-plane float between thread pairs 26–27, 28–29, 30–31, 32–33.

As can be seen from FIG. 20, two additional threads interwoven in accordance with FIGS. 18 and 19 produce a weave repeat structure having the appearance of a plain weave in the upper layer and two crossover points 93 and 94 which are spaced apart by at least three MD threads. This results from the additional longitudinal thread being in a continuous portion 95 of the weave repeat with seven adjacent MD threads between transitions from the machine or paper side longitudinal threads. Since the repeat pattern extends over twelve pairs of MD threads with only a single interlacing with the machine side MD layer, providing a ratio of interlacings with longitudinal machine side threads to paper side longitudinal threads of 1 in 12, and the additional threads can shift relative to each other, threads 90 and 91 tend to act as one thread in a continuous plain weave on the top layer. As a result of the long transitions and the interlacing patterns, the additional threads can migrate relative to each other to produce the desired sheet side weave pattern while also providing mid-plane floats and long transitions.

Figure 23:
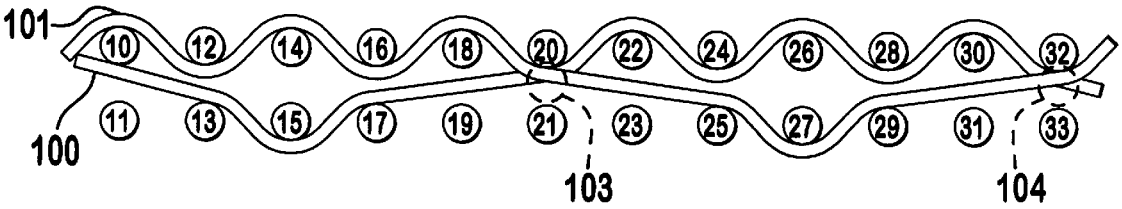
FIG. 23 shows the weave repeats of FIGS. 21 and 22 in combination.

The second additional thread 101 weaves in the mirror image of thread 100. As shown by FIG. 23, the threads 100 and 101 produce a plain weave pattern on the paper sheet side, relatively long transitions which combine to simulate a mid-plane float and cross over points 103, 104 which encourage migration of the threads relative to each other. As with the prior embodiment, this embodiment provides a continuous portion 105 of the weave repeat that extends for a length of at least five adjacent paper side longitudinal threads between transitions from the machine or paper side longitudinal threads.

Figure 24:
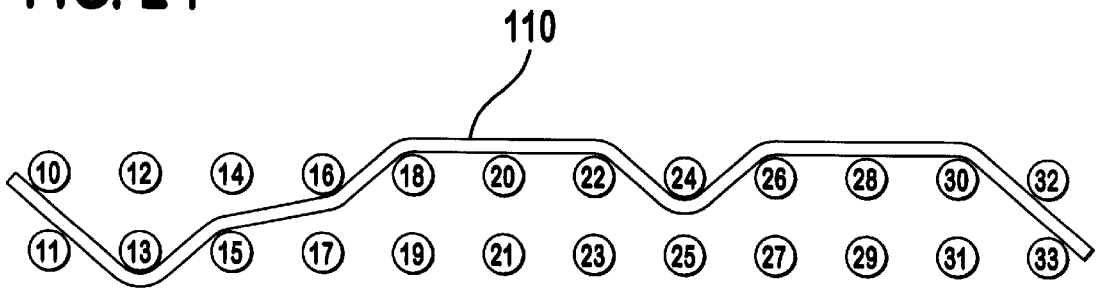
FIG. 24 illustrates the weave repeat for one additional thread in accordance with a seventh embodiment.
Figure 25:
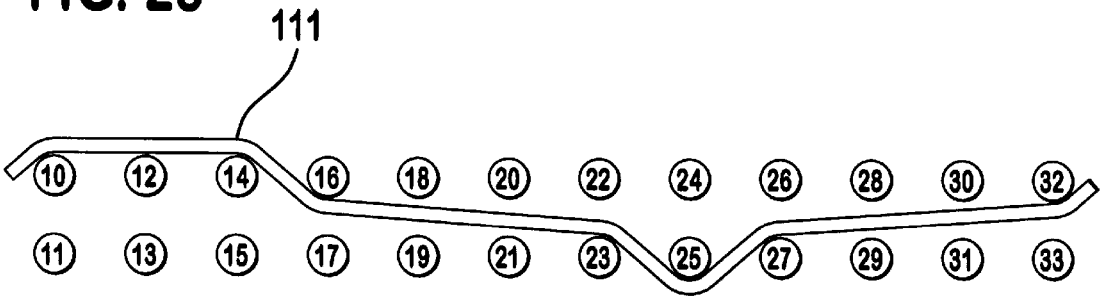
FIG. 25 illustrates the weave repeat for a second additional thread in accordance with the seventh embodiment.
Figure 26:
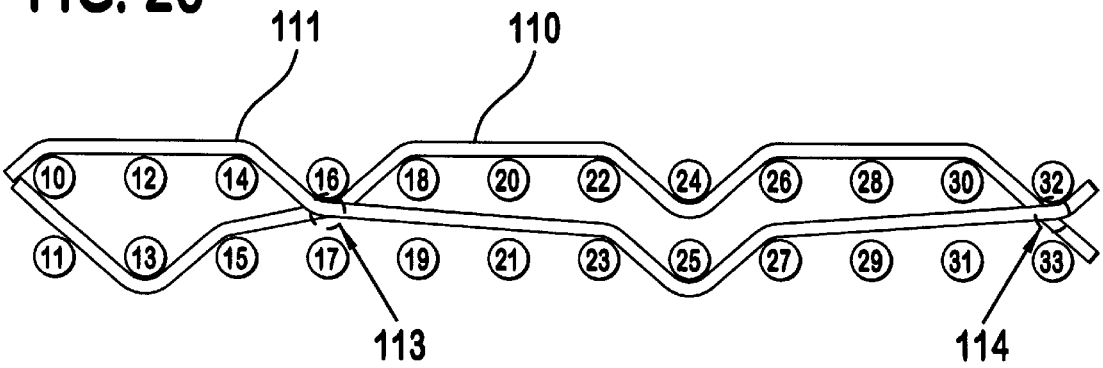
FIG. 26 shows the weave repeats of FIGS. 24 and 25 in combination.

Referring to FIGS. 24–26, a seventh embodiment is shown. Additional CMD thread 110 weaves in a repeat pattern that passes between MD threads 10–11, under MD threads 12–13, between MD thread pairs 14–15, 16–17, floats over MD threads 18–23, between MD threads 24–25, floats over MD threads 26–31 and between MD threads 32–33. With reference to FIG. 25, the second additional thread 111 is woven in a complementary weave pattern to that of thread 110. Additional thread 111 weaves over MD threads 10–15, between MD thread pairs 16–17, 18–19, 20–21, 22–23, under MD threads 24–25 and between MD threads 26–27, 28–29, 30–31, 32–33. It will be noted from FIG. 25 that additional thread 111 forms two mid-plane floats between four pairs of MD threads 16–17, 18–19, 20–21, 22–23 and 26–27, 28–29, 30–31, 32–33.

As can be seen from FIG. 26, two additional threads 110,111 as interwoven in FIGS. 24 and 25 produce a weave repeat structure having the appearance of an over three, under one repeat in the upper layer. The two crossover points, 113, 114 are spaced apart by at least three MD threads. This creates a long continuous portion of the second additional thread 111 which generally forms mid-plane floats that complement the long transition of the first additional thread 100. Since the repeat pattern extends over twelve pairs of MD threads with only a single interlacing with the machine side MD layer and the additional threads can shift relative to each other, threads 110 and 111 tend to act as one thread in a continuous over three, under one weave pattern on the top layer. With reference again to FIG. 24 and additional thread 110, it can be seen that the weave repeat of thread 110 includes a subrepeat of three over, one under which repeats twice within the pattern. This weave repeat permits the relatively loose interlacing of the thread 111 but enables the pattern to be continued throughout the upper layer when the threads 110, 111 are combined in accordance with FIG. 26.

Figure 27:
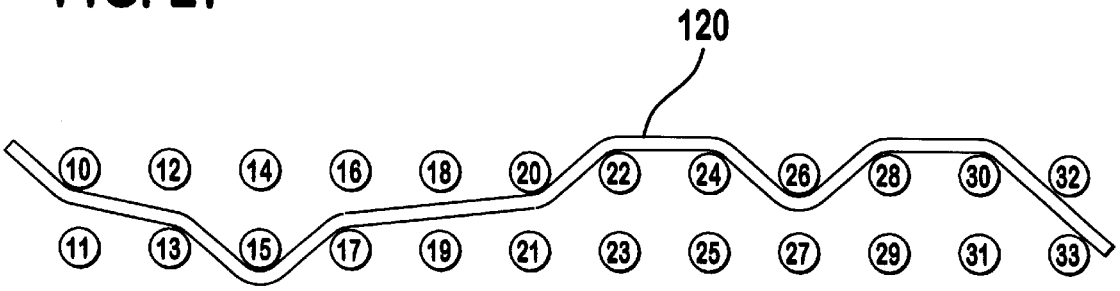
FIG. 27 illustrates the weave repeat for one additional thread in accordance with an eighth embodiment.
Figure 28:
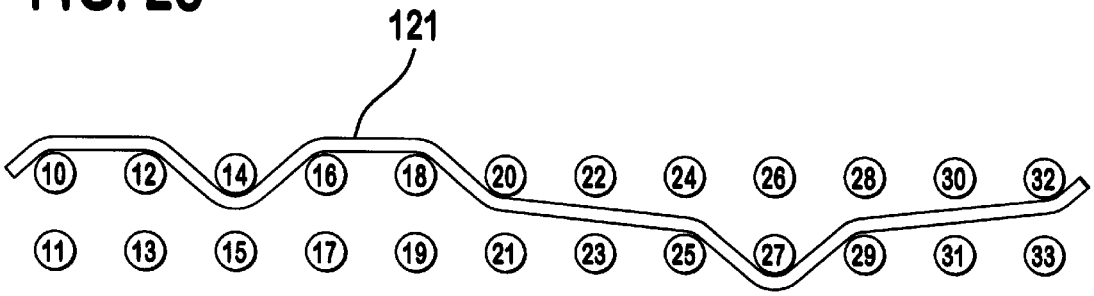
FIG. 28 illustrates the weave repeat for a second additional thread in accordance with the eighth embodiment.
Figure 29:
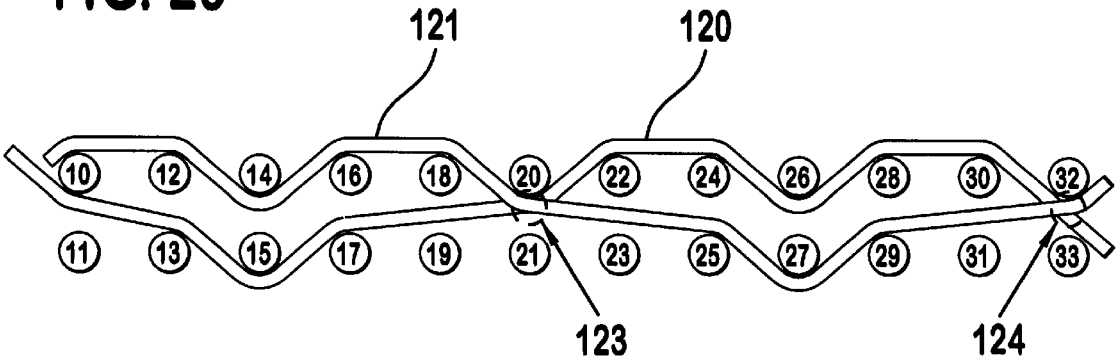
FIG. 29 shows the weave repeats of FIGS. 27 and 28 in combination.

With reference to FIGS. 27–29, there is shown an eighth embodiment of the present invention. In this eighth embodiment, the first additional thread 120 weaves between MD thread pairs 10–11, 12–13, beneath MD threads 14–15, between MD threads 16–17, 18–19, 20–21, and then in two repeats of the subrepeat pattern of over two, under one with upper MD threads 22, 24, 26, 28, 30, 32.

The second additional thread 121 weaves in the mirror image of thread 120. As shown by FIG. 29, the threads 120 and 121 produce an over two, under one weave pattern on the paper sheet side, relatively long transitions which combine to simulate continuous floats in the mid-plane and crossover points 123,124 which encourage migration of the threads relative to each other. As with the prior embodiment, this embodiment provides a weave repeat that includes two repeats of the subrepeat in adjacent paper side longitudinal threads between the transitions from the machine or paper side longitudinal threads.

Figure 30:
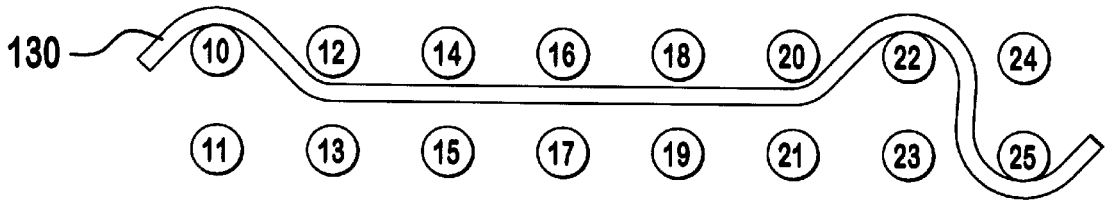
FIG. 30 illustrates the weave repeat for one additional thread in accordance with a ninth embodiment.
Figure 31:
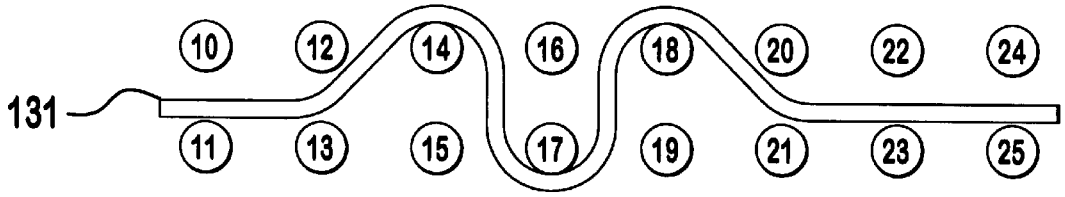
FIG. 31 illustrates the weave repeat for a second additional thread in accordance with the ninth embodiment.
Figure 32:
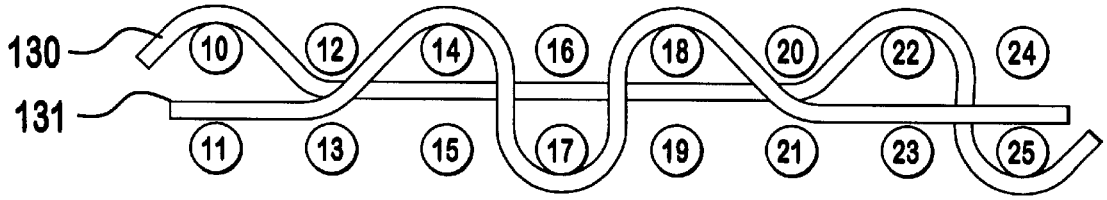
FIG. 32 shows the weave repeats of FIGS. 30 and 31 in combination.

Referring to FIGS. 30–32, a ninth embodiment is shown. The fabric repeats on sixteen MD threads 10–25. Each additional CMD thread 130 and 131 is interwoven in the seam zone 40 with both layers of MD threads 10 through 25. Additional CMD thread 130 weaves in a repeat pattern that passes over MD threads 10–11, between MD threads 12–13, 14–15, 16–17, 18–19, 20–21, over MD threads 22–23 and under MD threads 24–25. With reference to FIG. 31, the second additional thread 131 is woven in a complementary pattern to that of thread 130. Thus, CMD thread 131 weaves in a repeat that passes over threads 14–15, under threads 16–17, over threads 18–19 and between threads 20–21, 22–23, 24–25, 10–11, 12–13.

The complementary pattern of the repeats can be seen from FIG. 32. It will be noted from FIG. 32 that the weave repeats of threads 130 and 131 result in a transverse weave repeat that appears as a plain weave on the paper side surface of the fabric. Likewise, the mid-plane float repeat produces what is essentially a continuous float through the mid-plane of the fabric. This is particularly beneficial in two-layer fabric constructions. Finally, the weave repeats result in a single interlacing with the machine side of the fabric for each additional thread 130, 131.

Figure 33:
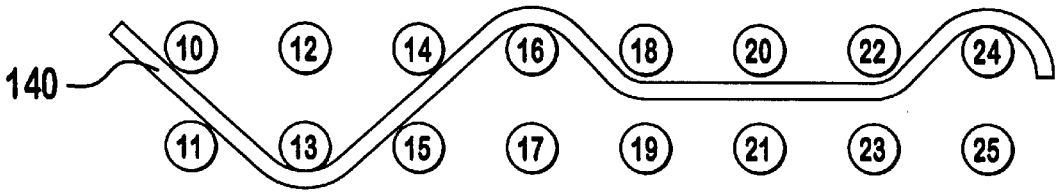
FIG. 33 illustrates the weave repeat for one additional thread in accordance with a tenth embodiment.
Figure 34:
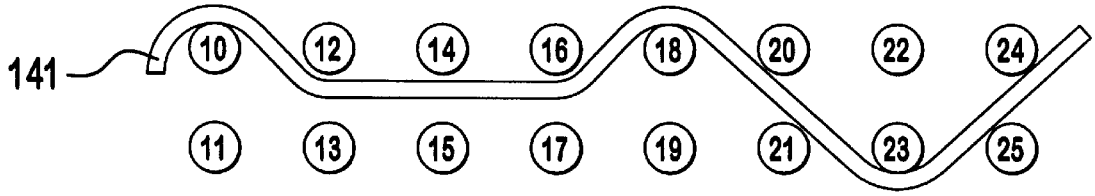
FIG. 34 illustrates the weave repeat for a second additional thread in accordance with the tenth embodiment.
Figure 35:
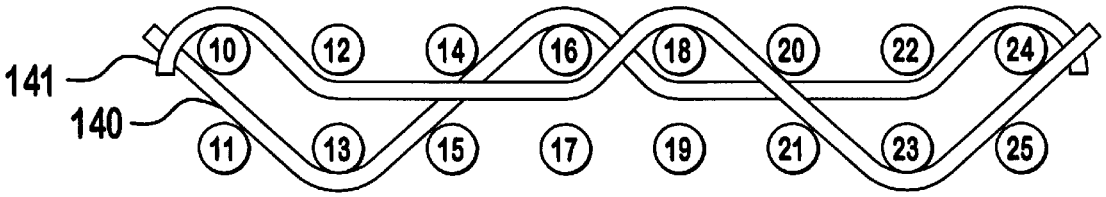
FIG. 35 shows the weave repeats of FIGS. 33 and 34 in combination.

With reference to FIGS. 33–35, there is shown a tenth embodiment of the present invention. In this embodiment, the transverse additional thread 140 weaves between MD threads 10–11, under MD threads 12–13, between MD threads 14–15, over MD threads 16–17, between MD thread pairs 18–19, 20–21, 22–23 and over MD threads 24–25. The additional transverse thread 141 weaves in a complementary pattern. Thread 141 weaves over MD threads 10–11, between MD thread pairs 12–13, 14–15, 16–17, over MD threads 18–19, between MD threads 20–21, under MD threads 22–23, and between MD threads 24–25. As can be seen from FIG. 35, these complementary weave patterns produce a sheet side weave pattern with adjacent pairs of plane weave knuckles alternating with pairs of MD threads that float over both of the additional transverse threads 140 and 141. In additional to producing long continuous mid-plane floats, these complementary patterns also provide for an increase in the thread's transition length from layer to layer. Accordingly, the threads 140 and 141 will transition under three sheet side MD threads while passing under only one machine side MD thread. Accordingly, this embodiment provides for a single machine side interlacing and long transitions while preserving a virtually continuous mid-plane float.

It will be appreciated that batt adhesion will be most improved on the sheet side surface but that some improvement in machine side surface adhesion will result from the presence of the interlacings and relatively long transitions.

The additional CMD threads in all embodiments may be multifilament, spun, braided, knitted, or bicomponent. If the thread is of a bicomponent nature, the bicomponent material may have a core material with a higher melting point surrounded by a covering of a lower melting point material. This allows the covering to melt and adhere to the batt material during finishing without affecting the core structure of the thread. Threads may be made from polymeric resins selected from a group consisting of polyamide, polyurethanes, polyesters, polyaramids, polyimides, polyolefins, polyetherketones, polypropylenes, PET, PBT, PTT, phenolics, and copolymers thereof.

What is claimed is:

1. An open ended papermaker's fabric of a type woven from a longitudinal thread system and a transverse thread system and having a paper side and a machine side, a plurality of seam loops at each end of the fabric formed by the threads of the longitudinal thread system whereby a seam zone is formed at each end of said fabric between the respective seam loops and a respective end thread of said transverse thread system, the fabric characterized by:

at least one additional transverse thread interwoven in at least one seam zone with the longitudinal thread system in a repeat pattern having a ratio of interlacings with longitudinal machine side threads to paper side longitudinal threads greater than zero and less than or equal to 1 in 6.

2. The fabric of claim 1 wherein the ratio is equal to 1 in 8.

3. The fabric of claim 1 wherein the ratio is equal to 1 in 12.

4. An open ended papermaker's fabric of a type woven from a longitudinal thread system and a transverse thread system and having a paper side and a machine side, a plurality of seam loops at each end of the fabric formed by the threads of the longitudinal thread system whereby a seam zone is formed at each end of said fabric between the respective seam loops and a respective end thread of said transverse thread system, the fabric characterized by:

two additional transverse threads interwoven in at least one seam zone with the longitudinal thread system, each of the two additional threads woven in a repeat pattern having a ratio of interlacings with longitudinal machine side threads to paper side longitudinal threads greater than zero and less than or equal to 1 in 6.

5. The fabric of claim 4 wherein the ratio for each of the two additional threads is equal to 1 in 8.

6. The fabric of claim 4 wherein the ratio for each of the two additional threads is equal to 1 in 12.

7. The fabric of claim 4 wherein each of the two additional threads weaves under only one machine side longitudinal thread in a given repeat.

8. The fabric of claim 7 wherein each of the two additional threads weaves over the machine side longitudinal thread which the other additional thread weaves under.

9. The fabric of claim 4 wherein the additional threads migrate relative to one another such that a portion of one of the additional threads overlies a portion of the other additional thread.

10. The fabric of claim 4 wherein the at least one seam zone has a loop length which is less than the loop length had each additional thread been woven in a repeat pattern of over, under adjacent pairs of the paper and machine side longitudinal threads.

11. A method of producing a papermaker's fabric comprising the steps of:

interweaving a longitudinal thread system with a transverse thread system to define a base fabric having first and second ends and a paper side and a machine side;

forming a plurality of seam loops at each end of the fabric from the threads of the longitudinal thread system and defining a seam zone at each end of said fabric between the respective seam loops and a respective end thread of said transverse thread system; and interweaving at least one additional transverse thread in at least one seam zone with the longitudinal thread system in a repeat pattern having a ratio of interlacings with longitudinal machine side threads to paper side longitudinal threads greater than zero and less than or equal to 1 in 6.

12. The method of claim 11 further comprising the step of interweaving a second additional transverse thread in the at least one seam zone with the longitudinal thread system in a repeat pattern having a ratio of interlacings with longitudinal machine side threads to paper side longitudinal threads greater than zero and less than or equal to 1 in 6.

* * * * *